US011623784B2

(12) United States Patent
Youell

(10) Patent No.: US 11,623,784 B2
(45) Date of Patent: Apr. 11, 2023

(54) PARTITIONED CONTAINER

(71) Applicant: DRYIP, LLC, Dublin, OH (US)

(72) Inventor: D. Rudolph Youell, Dublin, OH (US)

(73) Assignee: DRYIP, LLC, Dublin, OH (US)

( * ) Notice: Subject to any disclaimer, the term of this patent is extended or adjusted under 35 U.S.C. 154(b) by 87 days.

(21) Appl. No.: 17/208,650

(22) Filed: Mar. 22, 2021

(65) Prior Publication Data

US 2022/0297875 A1 Sep. 22, 2022

(51) Int. Cl.
*B65D 5/49* (2006.01)
*B65D 25/04* (2006.01)

(52) U.S. Cl.
CPC ..... *B65D 5/48038* (2013.01); *B65D 25/04* (2013.01)

(58) Field of Classification Search
CPC ..... B65D 5/48038; B65D 5/4808; B65D 5/0254; B65D 5/6608; B65D 25/04
USPC ..... 229/120.36, 120.31, 120.37, 120.38
See application file for complete search history.

(56) References Cited

U.S. PATENT DOCUMENTS 284,252 A * 9/1883 Smith ..... B65D 85/327 217/33
345,510 A 7/1886 Jenkins et al.
347,835 A 8/1886 Shibley
449,330 A 3/1891 Perkins
747,518 A 12/1903 Ward
1,313,948 A 8/1919 Maegly
1,767,629 A 6/1930 Walter
2,284,385 A * 5/1942 Freshwaters ..... B65D 5/48038 229/120.36
2,337,468 A 12/1943 Hilger
2,448,795 A 9/1948 Grecco
2,663,491 A * 12/1953 Hill ..... B65D 5/10 229/157
2,706,935 A * 4/1955 Pasjack ..... B65D 5/48038 229/120.31
2,709,547 A 5/1955 Niedringhaus
2,734,626 A 2/1956 Koester et al.
2,741,362 A 4/1956 Cortright
2,776,745 A 1/1957 Antwerpen
2,806,592 A 9/1957 Hatfield
2,807,360 A 9/1957 Nurre
2,919,022 A 12/1959 Lidgard
2,967,009 A 1/1961 Lidgard
(Continued)

FOREIGN PATENT DOCUMENTS

DE 102007033695 A1 * 8/2008 ..... B65D 5/48038
FR 1417280 A 11/1965
WO 2011010242 A1 1/2011

OTHER PUBLICATIONS

Machine Translation of DE-10207033695-A1 (Year: 2008).*

*Primary Examiner* — Justin M Larson
*Assistant Examiner* — Phillip D Schmidt
(74) *Attorney, Agent, or Firm* — Standley Law Group LLP; Jeffrey S. Standley; Bryan P. Finneran

(57) ABSTRACT

A partitioned container having a plurality of individual compartments formed from mated slotted interior panels. One or more exterior panels surround the mated interior panels to form the outside of the partitioned container. The interior panels may include folding tab sections and partitioning sections, and the panels may be positioned closely together to define small individual compartments. The various panels may be folded about fold lines to permit the assembly to be folded into a substantially flat state.

19 Claims, 6 Drawing Sheets

(56) References Cited

U.S. PATENT DOCUMENTS 3,028,001 A 4/1962 Gleim
3,043,488 A 7/1962 Warwick
3,044,615 A 7/1962 Richardson
3,166,188 A 1/1965 Koester
3,363,753 A 1/1968 Taylor
3,389,785 A 1/1968 Lidgard
3,385,462 A 5/1968 Deldime et al.
3,403,778 A 10/1968 Voytko et al.
3,414,124 A 12/1968 Lidgard
3,519,244 A 7/1970 Lidgard
3,557,719 A 1/1971 Gielas
3,756,397 A 9/1973 Ganz
3,878,943 A 4/1975 Ryan et al.
3,880,343 A 4/1975 Rockefeller
3,884,356 A 5/1975 Lidgard
3,900,157 A 8/1975 Roth
3,904,105 A 9/1975 Booth
3,930,438 A * 1/1976 Hackman ..... B31B 50/81 493/379
3,942,709 A 3/1976 Gepfer
3,990,576 A 11/1976 Heaney
3,995,736 A 12/1976 Lawson et al.
4,000,845 A * 1/1977 Zeller ..... B65D 5/48038 229/120.36
4,085,847 A 4/1978 Jacalone
4,225,043 A 9/1980 Lastik
4,287,990 A 9/1981 Kurick
4,306,653 A 12/1981 Fales
4,572,425 A 2/1986 Russell
4,697,699 A 10/1987 Scheider
4,785,957 A 11/1988 Beck et al.
4,805,774 A 2/1989 Salisbury
4,875,419 A 10/1989 Helton et al.
4,899,880 A 2/1990 Carter
4,930,632 A 6/1990 Eckert et al.
5,004,146 A 4/1991 Thominet et al.
5,101,976 A 4/1992 Salisbury
5,111,937 A 5/1992 Schutz
5,150,646 A 9/1992 Lonczak
5,269,422 A 12/1993 Chevrette
5,332,149 A 7/1994 Gepfer
5,441,154 A 8/1995 Youell, III
5,531,165 A 7/1996 Taravella et al.
5,595,301 A 1/1997 Putz et al.
5,671,857 A 9/1997 Stromberg
5,758,818 A 6/1998 Ewing, Jr.
5,785,239 A 7/1998 Campbell, II et al.
5,873,517 A 2/1999 Lisbon
5,918,744 A 7/1999 Bringard et al.
5,934,474 A 8/1999 Renninger et al.
5,992,630 A 11/1999 Brown et al.
6,050,410 A 4/2000 Quirion
6,070,726 A 6/2000 Graham
6,112,672 A 9/2000 Heil
6,149,009 A 11/2000 DeNola
6,196,449 B1 3/2001 Chen
6,309,334 B1 10/2001 Xapelli
6,669,082 B1 12/2003 Meyer
6,722,500 B2 4/2004 Deiger
6,769,548 B2 8/2004 Morell et al.
6,814,232 B1 11/2004 Morris et al.
6,880,313 B1 4/2005 Gessford et al.
6,886,692 B2 5/2005 Allison
6,896,175 B2 * 5/2005 Duke ..... B65D 5/48038 229/120.36
6,938,396 B2 9/2005 Okamoto
7,080,735 B2 7/2006 Allison
7,419,055 B2 9/2008 Manuel
7,455,214 B2 11/2008 Miller et al.
7,533,771 B2 5/2009 Allison
7,665,280 B2 2/2010 Youell, Jr. et al.
7,681,735 B2 3/2010 Youell, Jr.
7,775,419 B2 8/2010 Bale
8,474,686 B2 7/2013 Glaser et al.
9,096,349 B2 8/2015 Youell et al.
9,758,273 B2 9/2017 Youell et al.
9,878,817 B2 * 1/2018 Youell ..... B65D 5/32
2003/0222129 A1 * 12/2003 Williams ..... B65D 5/48004 229/120.31
2005/0023281 A1 2/2005 Bradford
2009/0272792 A1 11/2009 Yang et al.
2012/0223129 A1 * 9/2012 Oppenheimer .... B65D 5/46064 229/120.36
2016/0185483 A1 6/2016 Youell et al.
2017/0369200 A1 12/2017 Youell et al.
2018/0079548 A1 3/2018 Youell et al.

* cited by examiner

PARTITIONED CONTAINER

TECHNICAL FIELD

Exemplary embodiments of the present invention relate to a partitioned container for use with storage or transportation of various objects.

BACKGROUND AND SUMMARY

The present disclosure relates generally to containers, and more particularly to divided containers for use with object storage or shipping, such as for use in palletized shipping systems. Traditional divider systems are primarily configured for providing internal dividers within the box containing perimeter. The dividers may be formed of interlocking sheets. The interlocking sheets commonly comprise interior divided cells, and perimeter cells that are open around the perimeter of the divider. Alternatively, interlocking divider partitions do not delineate a complete perimeter cell, but provide for an abbreviated perimeter cell that functions as an air cell around the perimeter of the divider.

The use of perimeter cells results in a waste of a significant portion of the box container volume, and adds weight to the divider system that does not provide for additional item cells. In addition, heavy items carried in the interior cells may shift and collapse the perimeter air cells, allowing additional shifting of the contents of the box container. Shifting can cause impact damage or lead to the collapse of a stack of divider sections or box containers. Furthermore, the traditional divided container having exterior panels surmounting the interior divided cells cannot be folded about fold lines to a substantially flat state.

Certain issues with traditional divider systems have been previously addressed by introducing a crate formed from mated slotted transverse panels and slotted longitudinal panels, where said transverse panels and longitudinal panels (collectively or independently "interior panels") are surmounted by exterior panels, as disclosed in U.S. Pat. No. 9,096,349 B2 (the "349" patent) and other related patent applications. In the prior assemblies according to the '349 patent and other related patent applications ("the prior assemblies"), folding tab sections of the transverse and longitudinal panels may be "facially affixed" to the exterior panels (the folding tab section extends horizontally along a portion of an exterior panel for substantially the distance from a fold line of the folding tab section to a side edge of the folding tab section opposite of the fold line, and the folding tab section is substantially affixed to the exterior panel for the distance thereof), thus eliminating perimeter cells. Additionally, fold lines of the interior and exterior panels permit the assembly to be folded into a substantially flat state.

However, in the prior assemblies, each interior panel includes two folding tab sections, where each side of the interior panel includes a folding tab section. Because the two folding tab sections may be facially affixed to the exterior panels in such prior assemblies, the interior panels must be sufficiently spaced apart to permit the folding tab sections at each side, which extend in opposite directions with respect to one another, to be facially affixed to an adjacent portion of the exterior panels. Additionally, in the manufacturing process, it is difficult to facially affix narrower folding tab sections, such as folding tab sections less than 1 inch wide from side edge to fold line, to their respective exterior panels. Thus, it is not desirable to reduce the width of folding tab sections. Therefore, cell size may be limited to a large minimum volume in the prior assemblies. This may be an issue for the storage or transportation of smaller objects, which may suffer impact damage as they collide with one another if not sufficiently cushioned and isolated from one another by paperboard or other material defining the perimeter of a divider cell.

In view of the foregoing, alternatives to traditional interlocking divider systems known in the art and to the prior assemblies are needed to improve efficiency in the shipping and manufacturing industries.

It is an exemplary objective of the present invention to provide a partitioned container comprising a plurality of individual compartments or cells, wherein the individual cells are not limited to a large minimum volume by spacing requirements for affixing at least two transverse panel folding tab sections to exterior panel walls.

According to exemplary embodiments of the present invention, the partitioned container may include a series of substantially parallel transverse panels. Each transverse panel may include a top edge, a bottom edge, and a pair of side edges. Each transverse panel may include a partitioning section and one folding tab section, where said folding tab section extends from only one side of the partitioning section. The partitioning section of the transverse panel may have at least one slot extending upwardly from the bottom edge of the transverse panel. According to certain preferred embodiments, the one or more slots may be wider near the bottom edge to improve the rotatability of the transverse panel with respect to a longitudinal panel, and/or to reduce the overall weight of the transverse panel.

The exemplary partitioned container may additionally include a series of substantially parallel longitudinal panels. Each longitudinal panel may include a top edge, a bottom edge, and a pair of side edges. Each longitudinal panel may further include a partitioning section and two folding tab sections, where said folding tab sections extend from each side of the partitioning section. The partitioning section of the longitudinal panel may have at least one slot extending downwardly from the top edge of the longitudinal panel. According to certain preferred embodiments, the slot may be wider near the top edge to improve the rotatability of the longitudinal panel with respect to the transverse panel, and/or to reduce the overall weight of the longitudinal panel.

In other exemplary embodiments, each of the longitudinal panels may comprise only one folding tab section and each of the transverse panels may comprise two folding tab sections. In still other exemplary embodiments, each of both the longitudinal panels and the transverse panels may comprise only one folding tab section. In yet other exemplary embodiments, some, but not all, of the longitudinal panels and/or the transverse panels may comprise only one folding tab section.

In exemplary embodiments of the present invention, the longitudinal panels may be substantially perpendicularly disposed with the transverse panels, where transverse panel slots may be placed within longitudinal panel slots to create a crate of individual compartments. The number of slots in each of the transverse and longitudinal panels may be varied depending on the number of interior partitions or individual compartments desired.

In preferred embodiments, the partitioned container may also include at least one exterior panel. Each exterior panel may have a top edge, a bottom edge, and a pair of side edges. The at least one exterior panel may have a plurality of vertical fold lines. In some embodiments, the at least one exterior panel may have tabs at one edge and mating recesses corresponding to the tabs on the opposite edge. In other embodiments, the at least one exterior panel may have one or more tabs on one side edge that overlap a portion of the opposite edge when such an exterior panel is mated with a corresponding exterior panel. The at least one exterior panel may surmount the crate for forming an outside of the partitioned container. Each longitudinal panel folding tab section may be joined to an exterior panel. Additionally, each transverse panel folding tab section may be joined to an exterior panel. The resultant exemplary assembly defining the partitioned container may be folded about the various fold lines of the exterior panels, longitudinal panels, and transverse panels such as to a substantially flat state.

In exemplary embodiments, where only one folding tab section on any given one of the longitudinal panels and/or the transverse panels is provided, the longitudinal panels and/or the transverse panels may be provided in an alternating arrangement within the container such that the folding tab sections are located alternately on each side of a given one of the longitudinal panels and/or the transverse panels. In such embodiments, the folding tab section may be configured to extend through a gap between a free edge of an adjacent longitudinal panel and/or transverse panel and an exterior panel, such that the folding tab section extends substantially across two individual compartments of the partitioned container.

The present invention requires less material than traditional systems for manufacturing a specific sized container because the wasted space of perimeter cells is eliminated. Additionally, the foldability of the present design minimizes the amount of storage space needed for storing the exemplary container because the container, when folded, is in a substantially flat state. Furthermore, since certain exemplary interior panels include one folding tab section on only one side of the partitioning section, as opposed to folding tab sections on each side of the partitioning section, the spacing requirements for these certain exemplary interior panels are smaller than the spacing requirements for prior assembly interior panels. Thus, with exemplary embodiments of the present invention, individual cells are not limited to a large minimum volume by spacing requirements for facially affixing multiple interior panel folding tab sections. Therefore, smaller objects may be sufficiently cushioned and isolated from each other by paperboard or other material defining the perimeter of a divider cell, preventing impact damage from object collisions occurring during the shipping or transportation of said objects.

Furthermore, having certain exemplary interior panels including one folding tab section on only one side of the partitioning section permits the folding tab section to be enlarged relative to the divider cell. This may result in easier application of adhesive, for example, to the folding tab section for application to the exterior panel. This may likewise improve access and suitable surface area for the use of any other type of joining technique as an alternative to, or in addition to, adhesive, such as but not limited to staples, tape, combinations thereof, or the like. This may also simplify manufacturing, assembly, and/or breakdown of the container.

BRIEF DESCRIPTION OF THE DRAWINGS

In addition to the features and advantages mentioned above, other features and advantages disclosed herein will become more apparent from the following detailed description of exemplary embodiments when read in conjunction with the attached drawings, wherein like reference numerals across the several views refer to identical or equivalent features, and wherein.

DETAILED DESCRIPTION

The disclosed partitioned container is useful in shipping various objects, for example individual component parts for automobiles, in individual compartments so as to prevent damage to the various objects or component parts, for example by parts bumping against each other during shipment. The disclosed partitioned container may be shipped or stored in a relatively flat, folded down configuration and then unfolded for insertion of various objects or component parts. The entire volume of the partitioned container may be used for storing objects or component parts inasmuch as individual compartments fill the entire interior volume of the partitioned container. The disclosed partitioned container assembly may contain a plurality of fold lines and folding tab sections that permit folding of the assembly. Folding tab sections and gaps may further permit parallel panels to be placed in close proximity to one another to define small compartments protecting small component parts or objects from colliding with one another.

Figure 1:
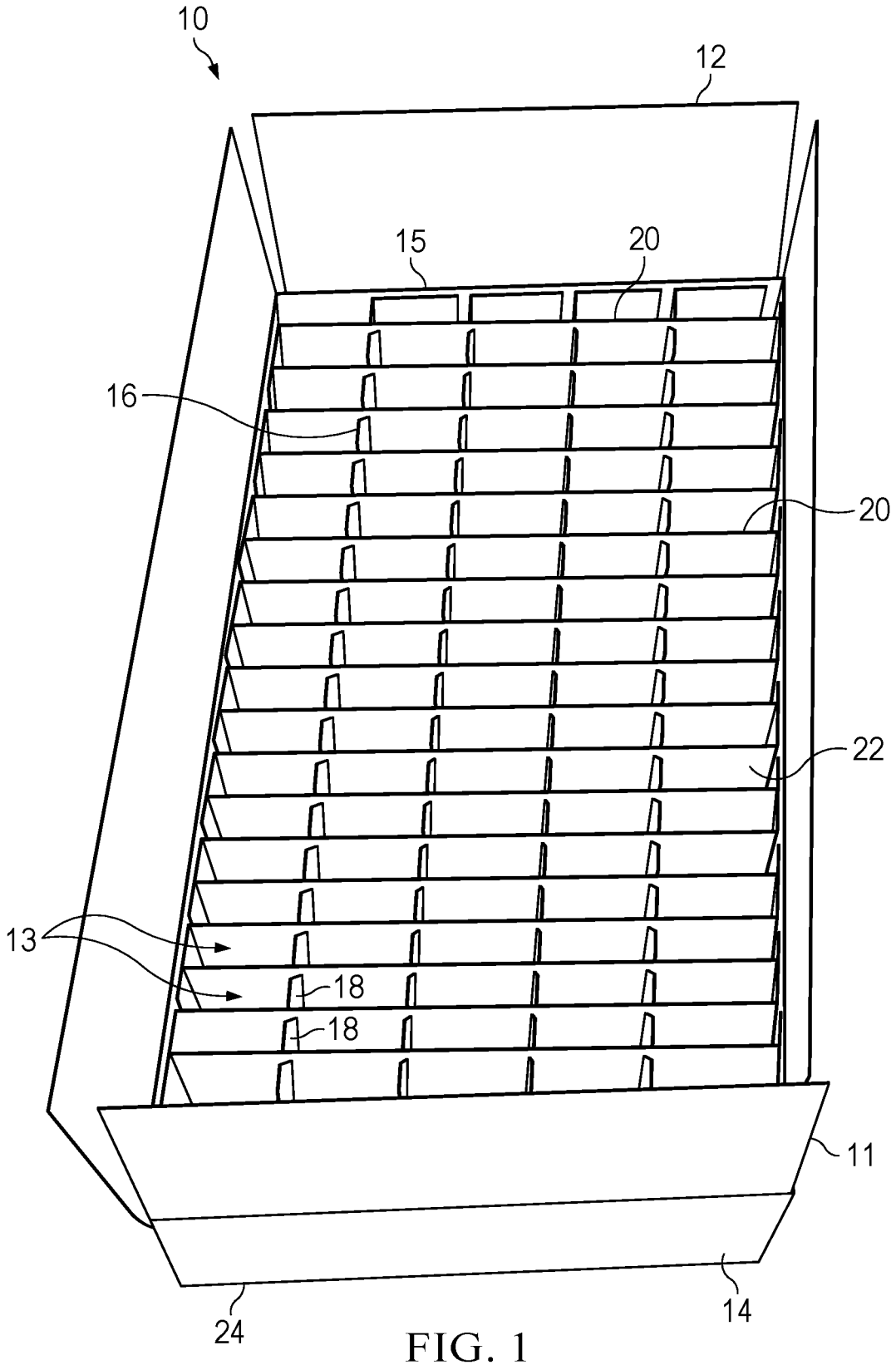
FIG. 1 is a perspective view of an exemplary partitioned container.

Referring initially to FIG. 1, an exemplary partitioned container 10 is shown. The partitioned container 10 comprises a plurality of individual cells or compartments 13 for stuffing with the same or different objects or component parts (not shown) for storage or shipment. The partitioned container 10 may be useful for shipping small automobile parts, although such use is not required. Such number of individual compartments 13 is by way of illustration and not limitation.

The partitioned container 10 may further comprise one or more longitudinal panels 16 having a plurality of panel tabs 18. The partitioned container 10 may additionally comprise one or more transverse panels 20 having a partitioning section 22. The transverse panels 20 and longitudinal panels 16 may interlock to define the perimeter of compartments 13, as described below. The transverse panels 20 and longitudinal panels 16 may be surmounted by one or more exterior panels 11 having walls 14 and exterior panel folding tab sections 12. The exterior panel folding tab sections 12 may be rotated about fold lines 15, and interlocked thereafter to define a roof of the partitioned container 10, such as for purposes of storing or shipping objects. In other embodiments, the roof of the partitioned container 10 may be a detachable lid. In certain embodiments, the base 24 of the partitioned container 10 may comprise a floor. In other embodiments, the base 24 of the partitioned container 10 may comprise one or more additional exterior panel folding tab sections. In yet other embodiments, the base 24 of the partitioned container 10 may comprise a pallet surface. It will be apparent to one of ordinary skill in the art that various surfaces and/or materials may be used to define the roof and/or base of an exemplary partitioned container.

Referring now to FIGS. 1-3B, a series of longitudinal panels, indicated generally at 26 (FIG. 2A) and 16 (FIGS. 1 and 2B), may be mated with a series of transverse panels, indicated generally at 44 (FIG. 3A) and 20 (FIGS. 1 and 3B), to form a crate of exemplary individual compartments 13 in the interior of the partitioned container 10. More specifically, in the embodiments shown, a series of transverse panel slots, such as indicated at 47 (FIG. 3A) and 55 (FIG. 3B), may be configured to cooperate for mutual insertion with a series of longitudinal panel slots, such as indicated at 29 (FIG. 2A) and 41 (FIG. 2B), when the slots are placed at substantially right angles to each other to form a crate of exemplary individual compartments 13 in the interior of the partitioned container 10.

Figure 2A:
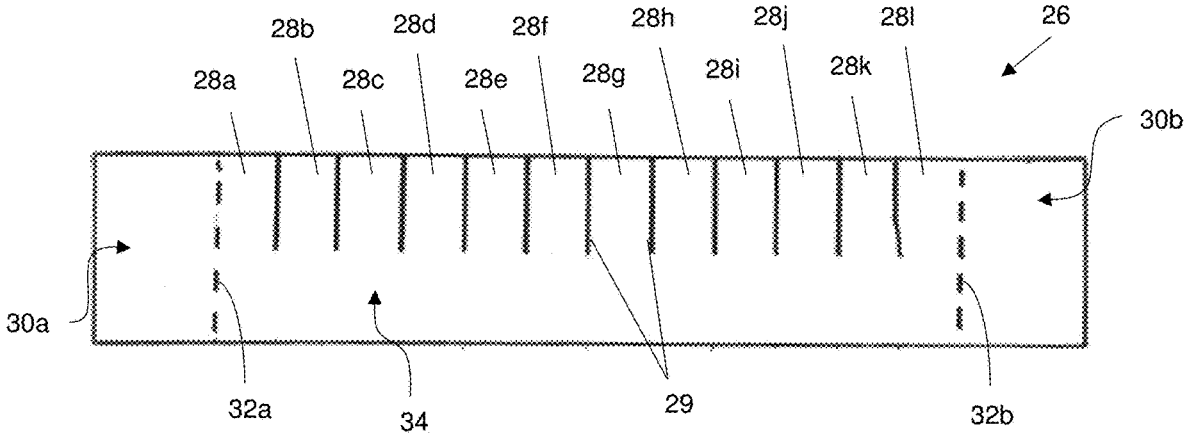
FIG. 2A is a plan view of a longitudinal panel according to an exemplary embodiment of the invention.

Referring specifically to FIG. 2A, an exemplary longitudinal panel 26 may include a partitioning section 34, and a pair of folding tab sections 30*a-b* which may be folded about fold lines 32*a-b*. The folding tab sections 30*a-b* may be located at opposite sides of the partitioning section 34. The fold lines 32*a-b* may run along the edge shared by the partitioning section 34 and the folding tab sections 30*a-b*, from top to bottom of the partitioning section 34, forming inner side edges of the folding tab sections 30*a-b*, respectively. The partitioning section 34 may further comprise a series of slots 29 separating panel tabs 28*a-l*. The slots 29 may extend downwardly from the top edge of the panel 26 to about a midpoint of the height thereof.

Figure 2B:
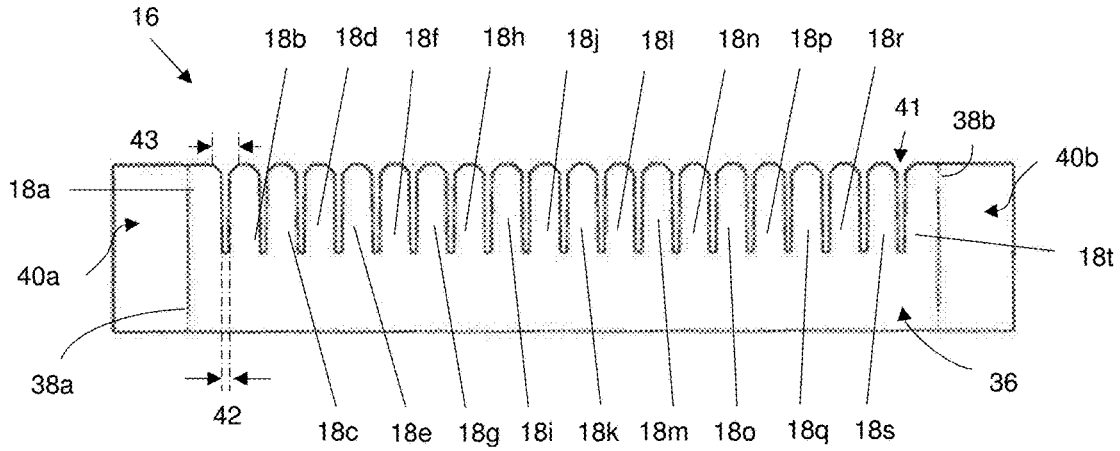
FIG. 2B is a plan view of a longitudinal panel according to another exemplary embodiment of the invention.

In another exemplary embodiment, FIG. 2B shows a longitudinal panel 16 having a partitioning section 36 and folding tab sections 40*a-b* which may be folded about fold lines 38*a-b*. The partitioning section 36 may comprise a series of slots 41 between panel tabs 18*a-t*, where the slots 41 extend downwardly from the top edge of the panel 16 to about a midpoint of the height thereof. Each panel tab 18*a-t* may comprise non-right-angle corners along a top edge, such that, for example, each slot 41 may comprise a narrow gap 42 and wide gap 43. Referring back to FIG. 1 in addition to FIG. 2B, the narrow gaps 42 may function to receive and secure the partitioning section 22 of transverse panels 20, and the wide gaps 43 may facilitate the rotation of the transverse panels 20 with respect to the longitudinal panels 16 by reducing friction between the panels 20, 16 by reducing the contact area between the partitioning section 22 of the transverse panel 20 and each panel tab 18*a-t* of the partitioning section 36 of the longitudinal panel 16. Additionally, this particular configuration may reduce the overall weight of each longitudinal panel 16 by reducing the relative surface area of each panel tab 18*a-t* with respect to empty space defined by each slot 41. In certain exemplary embodiments, the partitioning section 36 of the longitudinal panel 16 may be approximately 22.5 inches wide from fold line 38*a* to fold line 38*b*. Additionally, each exemplary folding tab section 40*a-b* may be approximately 2 inches wide from outer side edge to fold line 38*a-b*. Furthermore, the exemplary longitudinal panel 16 may be approximately 5 inches tall from top edge to bottom edge, and each panel tab 18*a-t* may be approximately 2.5 inches tall from top edge to a bottom of the slot 41.

Figure 3A:
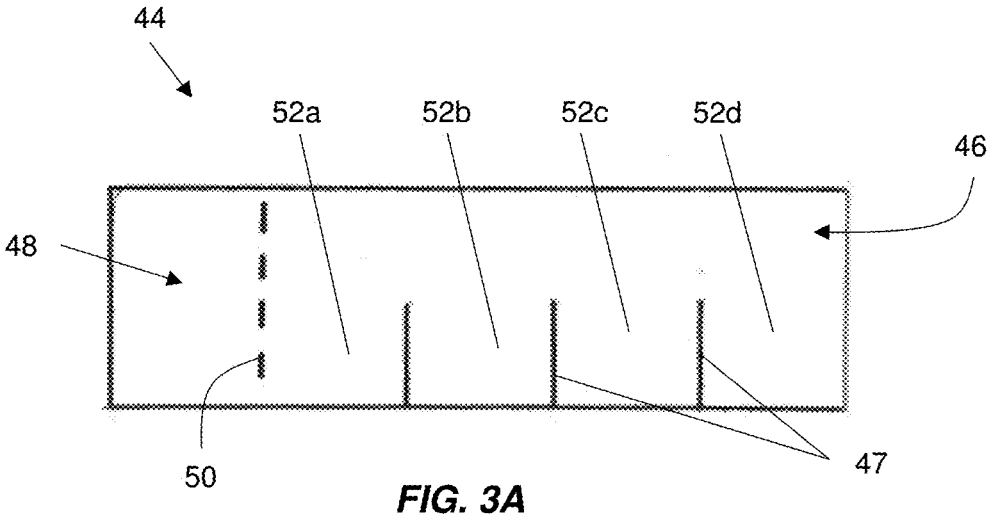
FIG. 3A is a plan view of a transverse panel according to an exemplary embodiment of the invention.

Referring now specifically to FIG. 3A, an exemplary transverse panel 44 may include a partitioning section 46 and a folding tab section 48 which may be folded about a fold line 50. The folding tab section 48 may extend from one side of the partitioning section 46. The fold line 50 may run along the edge shared by the partitioning section 46 and the folding tab section 48, from top to bottom of the partitioning section 46, forming an inner side edge of the folding tab section 48. The partitioning section 46 may further comprise a series of slots 47 separating panel tabs 52*a-d*. The slots 47 may extend upwardly from a bottom edge of the panel 44 to about a midpoint of the height thereof.

Figure 3B:
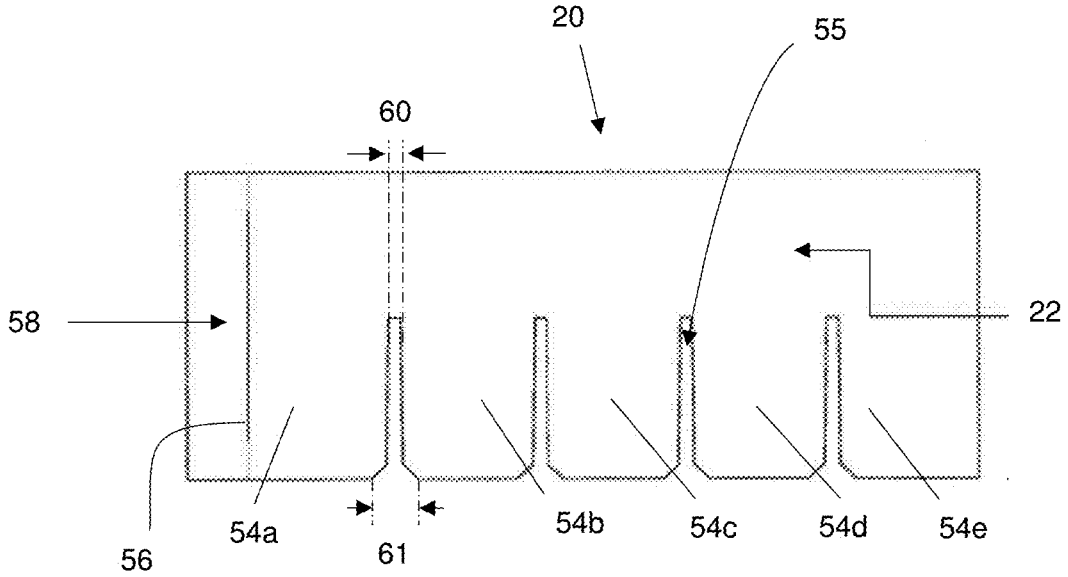
FIG. 3B is a plan view of a transverse panel according to another exemplary embodiment of the invention.

FIG. 3B shows an exemplary transverse panel 20 having a partitioning section 22 and a folding tab section 58 which may be folded about a fold line 56. The partitioning section 22 may comprise a series of slots 55 between panel tabs 54*a-e*, where the slots 55 extend upwardly from a bottom edge of the panel 20 to about a midpoint of the height thereof. Each panel tab 54*a-e* may comprise non-right-angle corners along a bottom edge, such that, for example, each slot 55 may comprise a narrow gap 60 and wide gap 61. Referring back to FIG. 1 in addition to FIG. 3B, the narrow gaps 60 may function to receive and secure the partitioning section 36 of longitudinal panels 16, and the wide gaps 61 may facilitate the rotation of the longitudinal panels 16 with respect to the transverse panels 20 by reducing friction between the panels 20, 16 by reducing the contact area between the partitioning section 36 of the longitudinal panel 16 and each panel tab 54*a-e* of the partitioning section 22 of the transverse panel 20. Additionally, this particular configuration may reduce the overall weight of each transverse panel 20 by reducing the relative surface area of each panel tab 54*a-e* with respect to empty space defined by each slot 55. In certain exemplary embodiments, the folding tab section 58 may be approximately 2 inches wide from outer side edge to fold line 56. Additionally, the exemplary partitioning section 22 may be approximately 12 inches wide from open side edge to fold line 56. Furthermore, the exemplary transverse panel 20 may be approximately 5 inches tall from bottom edge to top edge, and each panel tab 54*a-e* may be approximately 2.5 inches tall from bottom edge to top of the slot 55.

Referring to FIGS. 2A-3B, the number of slots, indicated generally at 29 (FIG. 2A), 41 (FIG. 2B), 47 (FIG. 3A) and 55 (FIG. 3B), could be in greater or fewer number than that shown in the drawings. Thus, the number of individual compartments for exemplary partitioned containers is a matter of choice and may be fewer or greater than that shown in the drawings.

Figure 4:
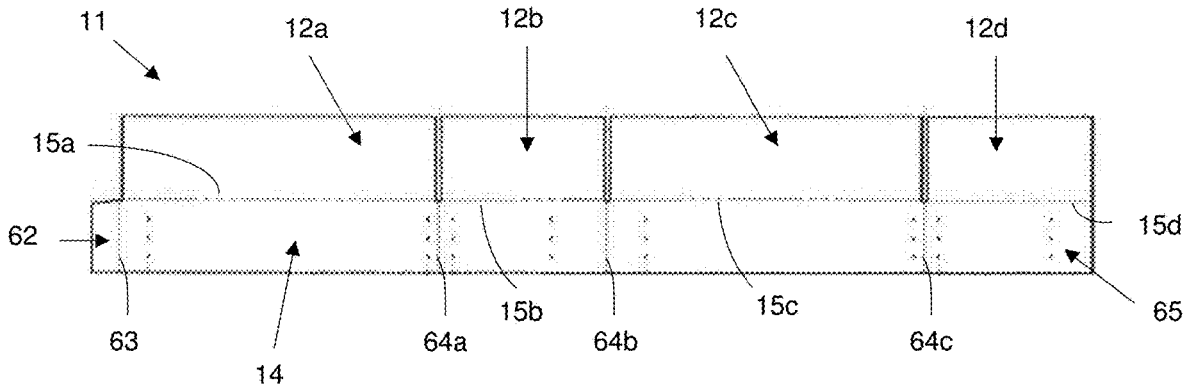
FIG. 4 is a plan view of an exterior panel according to an exemplary embodiment of the invention.
Figure 5:
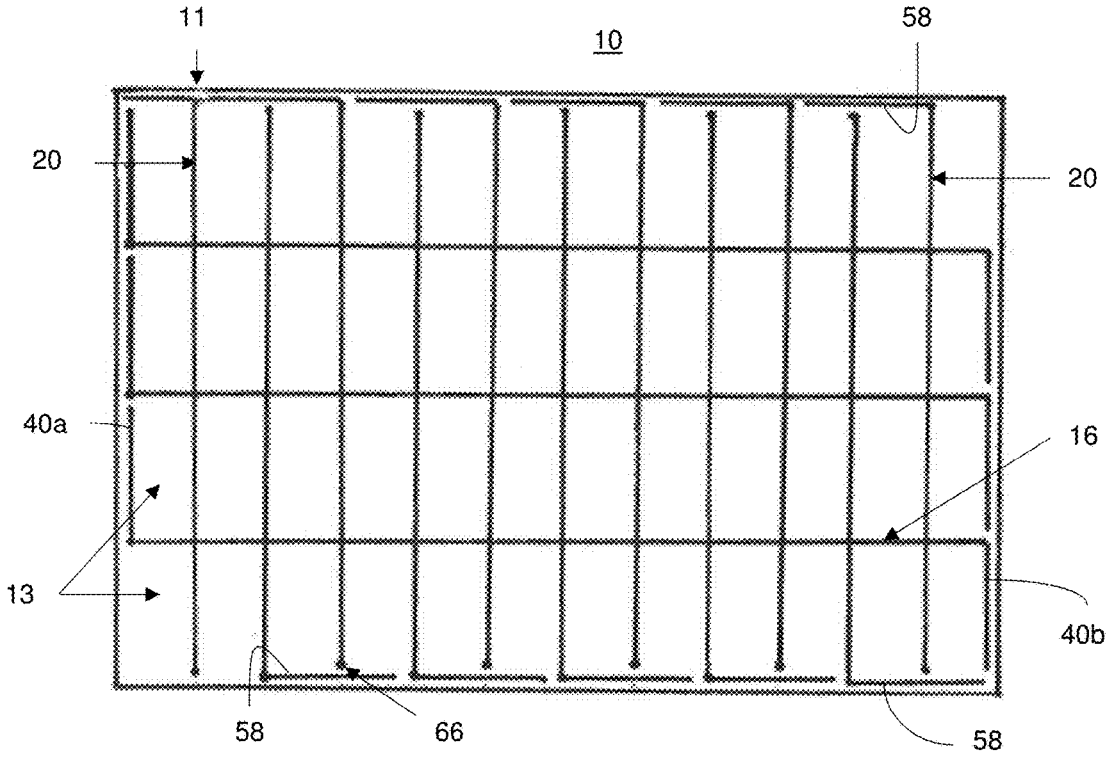
FIG. 5 is a top view of an exemplary partitioned container.

Referring now to FIG. 4, an exterior panel 11 according to an exemplary embodiment of the present invention is shown. The exterior panel 11 may comprise a plurality of walls 14, a plurality of folding tab sections 12*a-d* extending upward from the top edge of each wall 14, fold lines 15*a-d* at the bottom edge of folding tab sections 12*a-d* and top edge of each wall 14, and a mating tab 62. The walls 14 may be rotated with respect to one another about fold lines 64*a-c*. The folding tab sections 12*a-d* may be rotated with respect to the walls 14 about fold lines 15*a-d*. Referring now to FIG. 5 in addition to FIG. 4, the mating tab 62 may be rotated about a fold line 63 to be affixed to an open-end wall 65, permitting the exterior panel 11 to fully surmount the crate of interlocked transverse panels 20 and longitudinal panels 16, thus defining the outside of the partitioned container 10. The mating tab 62 may be affixed to the open-end wall 65 by adhesive, tape, bands or other securing mechanisms. In certain exemplary embodiments, folding tab sections 12*a* and 12*c* may be approximately 22.5 inches wide from side edge to side edge, folding tab sections 12*b* and 12*d* may be approximately 12 inches wide from side edge to side edge, and folding tab sections 12*a-d* may be approximately 11 inches long from top edge to fold line 15*a-d*. Additionally, the exemplary mating tab 62 may be approximately 2 inches wide from side edge to fold line 63, and 5 inches tall from top edge to bottom edge.

The present invention is not intended to be limited to the use of a single exterior panel having a mating tab. Depending on the number of compartments desired, a plurality of exterior panels may be required to form the outside of the partitioned container. In such an embodiment, the number of fold lines will be adjusted accordingly. In some embodiments, the exterior panels have a mating recess corresponding to the tabs on the opposite edge. In other embodiments, the exterior panels may have tabs at one edge and mating recesses corresponding to the tabs on the opposite edge. It will be apparent to those of ordinary skill in the art that there are various ways to surmount an exemplary crate of interlocked transverse panels and longitudinal panels to define the outside of an exemplary partitioned container.

In FIG. 5, the interlocked transverse panels 20 and longitudinal panels 16 surmounted by the exterior panel 11 are seen in a position forming individual compartments 13 of an exemplary partitioned container 10. Referring back to FIGS. 2B and 3B in addition to FIG. 5, the folding tab sections 40*a-b* of each longitudinal panel 16 may be facially affixed to the exterior panel 11. Furthermore, the folding tab section 58 of each transverse panel may be facially affixed to the exterior panel 11. Adjacent transverse panels 20 may have the folding tab section 58 located on the opposite side of the partitioning section 22 of the transverse panel 20 with respect to each other in an alternating arrangement within the partitioned container 10. In the embodiment shown, a transverse panel gap 66 permits the side of the transverse panel 20 without a folding tab section to be placed in close proximity to a midpoint of the folding tab section 58 of the adjacent transverse panel 20 without obstructing said adjacent panel's 20 rotation ability or its folding tab section's 58 connection to the exterior panel 11. The folding tab section 58 may be configured to extend through the transverse panel gap 66 past a free edge of the adjacent transverse panel 20 such that the folding tab section 58 extends substantially across two individual compartments 13 of the partitioned container 10. The exemplary configurations of FIGS. 2B, 3B and 5 permit the partitioning sections 22 of the various transverse panels 20 to be placed in close parallel proximity to one another. An advantage of this particular configuration is that compartments 13 are not limited to a large maximum volume. For example, in certain preferred embodiments, the compartments may be less than 10 cubic inches in volume when the partitioned container 10 perimeter is substantially cuboid. Thus, smaller objects may be stored or shipped in various individual compartments 13 using the exemplary partitioned container 10.

It is not intended that the present invention be limited to the use of transverse panel gaps 66 and multiple folding tab sections 40 with respect to longitudinal panels 16. For example, in other exemplary embodiments, each of the longitudinal panels may comprise only one folding tab section and each of the transverse panels may comprise two folding tab sections. In such embodiments, adjacent longitudinal panels may include folding tab sections located on the opposite side of the partitioning section of the longitudinal panel with respect to one another in an alternating arrangement within the partitioned container. A longitudinal panel gap may permit the side of the longitudinal panel without a folding tab section to be placed in close proximity to a midpoint of the folding tab section of the adjacent longitudinal panel without obstructing said adjacent panel's rotation ability or its folding tab section's connection to the exterior panel. The longitudinal panel folding tab section may be configured to extend through the longitudinal panel gap past the adjacent longitudinal panel free edge such that the folding tab section extends substantially across two individual compartments of the partitioned container. In such embodiments, the partitioning sections of the various longitudinal panels may be placed in close parallel proximity to each other.

In still other exemplary embodiments, each of both the longitudinal panels and the transverse panels may comprise only one folding tab section. In yet other exemplary embodiments, some, but not all, of the longitudinal panels and/or the transverse panels may comprise only one folding tab section. The longitudinal panels and/or the transverse panels may be provided in an alternating arrangement within the container such that the folding tab sections are located alternately on each side of adjacent longitudinal panels and/or transverse panels.

Given that with exemplary embodiments, folding tab sections may extend across more than one individual compartment of the partitioned container, folding tab sections may be enlarged relative to the individual compartments. Enlarging the folding tab sections may result in easier application of adhesive to, for example, the folding tab section applied to the exterior panel. This may likewise improve access and suitable surface area for the use of any other type of joining technique as an alternative to, or in addition to, adhesive, such as but not limited to staples, tape, combinations thereof, or the like. This advantage may simplify manufacturing, assembly, and/or breakdown of the container.

Figure 6:
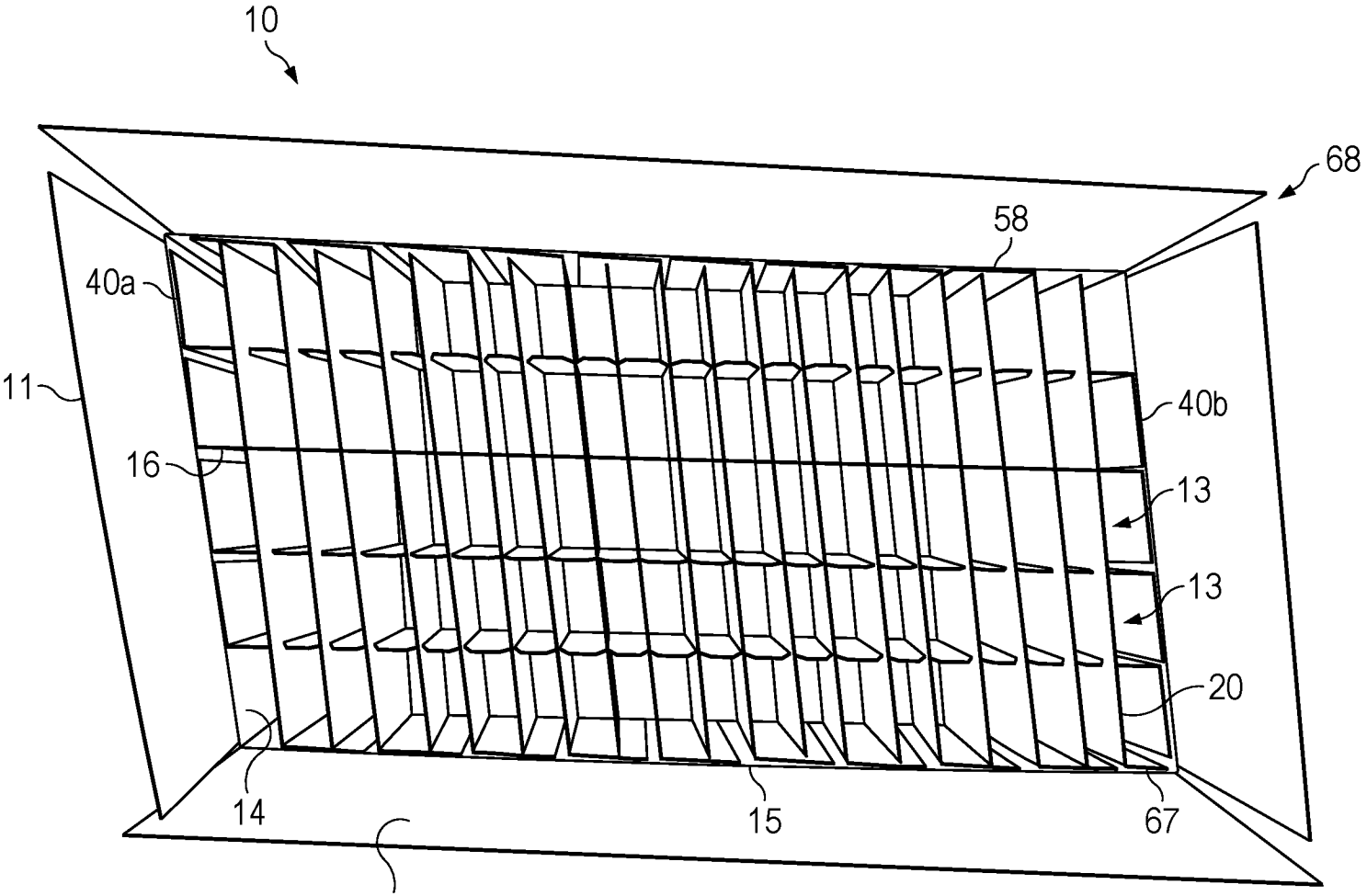
FIG. 6 shows a top view of the exemplary partitioned container of FIG. 1.

Referring now to FIG. 6, the exemplary partitioned container 10 of the FIG. 1 embodiment is shown. The exemplary partitioned container 10 may comprise longitudinal panels 16 having folding tab sections 40*a-b* facially affixed to the exterior panel 11, and transverse panels 20 having folding tab sections 58 facially affixed to the exterior panel 11. The interlocking of the longitudinal panels 16 and transverse panels 20 may form the plurality of individual compartments 13. The exterior panel folding tab sections 12 are shown in an open position, permitting objects (not shown) to be introduced to or removed from the various compartments 13. The exterior panel folding tab sections 12 may be folded about fold lines 15 and interlocked thereafter to form a roof of the partitioned container 10. In this particular embodiment, a floor 68 defines the base of the partitioned container 10. Additionally, in certain preferred embodiments, the transverse panel folding tab sections 58 and longitudinal panel folding tab sections 40 may extend beyond the top edge of their respective partitioning sections to add rigidity and strength to the walls 14 of the exterior panel 11.

In the FIG. 6 embodiment, a modified folding tab section 67 is shown at one end of the partitioned container 10, where the width from side edge to fold line of the modified folding tab section 67 is approximately half the width from side edge to fold line of the other transverse panel 20 folding tab sections 58. A modified folding tab section 67 may be useful for keeping compartment 13 size consistent near either end of the partitioned container 10, and for keeping the distance between substantially parallel transverse panels 20 substantially equal across the partitioned container 10. The width of the modified folding tab section 67 may be approximately 1 inch wide from open edge to fold line, and the individual compartments 13 across the partitioned container 10 may each have a substantially equal volume of approximately 10 cubic inches when the partitioned container 10 perimeter is substantially cuboid.

Figure 7:
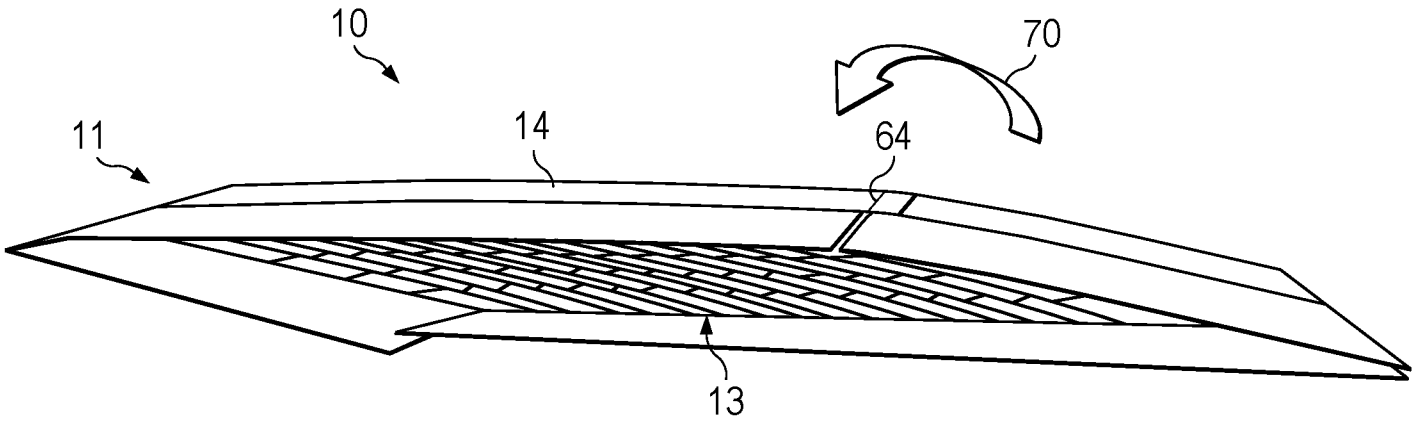
FIG. 7 is a perspective view of the partitioned container of FIG. 1 starting to be folded into a substantially flat state.

As is illustrated in FIG. 7, the exemplary partitioned container 10 of the FIG. 6 embodiment may be folded (fold direction demonstrated by arrow 70) into a substantially flat state. Force may be applied to one or more portions of a substantially empty partitioned container 10 to cause the interior panel partitioning sections and folding tab sections to rotate about respective fold lines, and to cause exterior panel walls 14 to rotate about their fold lines 64 until air volumes defining the interiors of each substantially empty compartment 13 have been substantially reduced. For example, the partitioned containers 10 may be folded substantially flat for storage and/or stacking. Additionally, the partitioned containers 10 may be folded substantially flat for shipment. The flattened configuration may reduce costs for users as a result of requiring less space while being transported or stored in an empty state. When it is desired that the partitioned container 10 in the substantially flat state is to have objects introduced to it, the process shown in FIG. 7 may be reversed until the configuration shown in FIG. 6 is reached.

Materials of construction for forming certain exemplary partitioned containers may be paperboard or corrugated material, such as, for example, cardboard, pasteboard, fiberboard, corrugated plastic sheets, or the like. However, other recyclable material having the necessary strength and rigidity for the particular application envisioned may be suitable. It will be appreciated that component part construction thereof, i.e., single-ply, double-ply, or higher, may be varied depending upon the application. The partitioned containers are shown and described in particular reference to the use of corrugated paperboard; however, such description is illustrative and not a limitation on the present disclosure.

While the partitioned containers have been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the partitioned container not be limited to the particular embodiments disclosed. All citations referenced herein are expressly incorporated herein by reference.

While certain embodiments of the present invention are described in detail above, the scope of the invention is not to be considered limited by such disclosure, and modifications are possible without departing form the spirit of the invention as evidenced by the following claims:

What is claimed is:

1. A partitioned container comprising:

one or more exterior panels defining an interior compartment;

a first number of interior partitions, each comprising:

a partitioning section comprising a number of slots extending from one of a top edge or a bottom edge to an intermediate height;

a folding tab section extending from a first side edge of the partitioning section such that a second side edge comprises a free edge, wherein said folding tab section is configured for folding about a vertically extending fold line located at an intersection of the partitioning section and said folding tab section;

wherein each of said folding tab sections are attached to one of said one or more exterior panels;

wherein each of said partitioning sections extend alongside one another and substantially cross said interior compartment in a first direction;

a second number of interior partitions, each comprising:

a partitioning section comprising a number of slots extending from one of a top edge or a bottom edge to an intermediate height thereof;

a first folding tab section extending from a right-side edge of the partitioning section, and configured for folding about a vertically extending fold line located at said right-side edge;

a second folding tab section extending from a left-side edge of the partitioning section, and configured for folding about a vertically extending fold line located at said left-side edge;

wherein each of said partitioning sections extend alongside one another and substantially cross said interior compartment in a second direction intersecting said first direction;

wherein said first folding tab section of each of said second number of interior partitions extends in a first direction;

wherein said second folding tab section of each of said second number of interior partitions extends in a second direction opposing said first direction;

wherein each of said first folding tab sections and each of said second folding tab sections are attached to one of said one or more exterior panels; and wherein each of said partitioning sections of each of said first number of interior partitions are mated with each of said partitioning sections of each of said second number of interior partitions by way of said slots in said partitioning sections of said first and second number of interior partitions to define a series of individual compartments within the interior compartment.

2. The partitioned container of claim 1 further comprising:

a gap between said free edge of said partitioning section of each of said first number of interior partitions and an interior surface of an adjacent portion of said one or more exterior panels.

3. The partitioned container of claim 2, wherein:

each of said folding tab sections of each of said first number of interior partitions, as well as each of said folding tab sections of each of said second number of interior partitions, extends across, and is affixed to, an interior surface of a respective adjacent portion of said one or more exterior panels.

4. The partitioned container of claim 3, wherein:

said first number of interior partitions are arranged such that said folding tab section of each respective one of said first number of interior partitions extends from an opposite side edge of said partitioning section of the respective one of said first number of interior partitions relative to an adjacent one of said first number of interior partitions; and said folding tab section of said respective one of said first number of interior partitions extends through said gap associated with said adjacent one of said first number of interior partitions.

5. The partitioned container of claim 4, wherein:

each folding tab section of said first number of interior partitions extends through a first one of said individual compartments of said partitioned container and into a second one of said individual compartments.

6. The partitioned container of claim 1, wherein:
said interior compartment is cuboid in shape.
7. The partitioned container of claim 6, wherein:
said one or more exterior panels comprise a mating tab affixed to an exterior surface of said one or more exterior panels to create a perimeter.
8. The partitioned container of claim 1, wherein:
said number of slots in said partitioning section of said first number of interior partitions extend from the bottom edge to said intermediate height; and
said number of slots in said partitioning section of said second number of interior partitions extend from the top edge to said intermediate height.
9. The partitioned container of claim 1, wherein:
said number of slots of each of said first number of interior partitions are spaced apart from one another and at least partially define a plurality of panel tabs, each comprising non-right-angle corners along an open edge.
10. The partitioned container of claim 1, wherein:
said number of slots of each of said second number of interior partitions are spaced apart from one another and at least partially define a plurality of panel tabs, each comprising non-right-angle corners along an open edge.
11. The partitioned container of claim 1, wherein:
said partitioned container comprises corrugated paperboard.
12. The partitioned container of claim 1, wherein:
said partitioned container is configured for folding about fold lines such that adjacent ones of said first number of interior partitions or second number of interior partitions are configured to selectively contact one another.
13. The partition container of claim 1, wherein:
said one or more exterior panels further comprise one or more exterior panel folding tab sections, wherein each of said one or more exterior panel folding tab sections are configured to rotate about a fold line to surround a plurality of individual compartments.
14. The partition container of claim 13, wherein:
a plurality of exterior panel folding tabs are configured to interlock with one another to cover a plurality of individual compartments.
15. A partitioned container comprising:
one or more exterior panels defining an interior compartment;
a first number of interior partitions, each comprising:
a partitioning section comprising a number of slots extending from one of a top edge or a bottom edge to an intermediate height;
a second number of interior partitions, each comprising:
a partitioning section comprising a number of slots extending from one of a top edge or a bottom edge to an intermediate height thereof;
wherein each of said partitioning sections of said first number of interior partitions extend alongside one another and substantially cross said interior compartment in a first direction;
wherein each of said partitioning sections of said second number of interior partitions extend alongside one another and substantially cross said interior compartment in a second direction intersecting said first direction;
wherein a plurality of interior partitions include a folding tab section extending from one of a first side edge of a partitioning section such that a second side edge comprises a free edge, wherein said folding tab section is configured for folding about a vertically extending fold line located at an intersection of the partitioning section and said folding tab section;
wherein each of said folding tab sections are attached to one of said one or more exterior panels;
wherein each of said partitioning sections of each of said first number of interior partitions are mated with each of said partitioning sections of each of said second number of interior partitions by way of said slots in said partitioning sections of said first and second number of interior partitions to define a series of individual compartments within the interior compartment;
wherein the partitioned container further comprises a gap between said free edge and an interior surface of an adjacent portion of said one or more exterior panels; and
wherein a folding tab section of an adjacent interior partition extends through said gap, and across more than one individual compartment of said partitioned container.
16. The partition container of claim 15, wherein:
a plurality of interior partitions include:
a first folding tab section extending from a right-side edge of the partitioning section, and configured for folding about a vertically extending fold line located at said right-side edge;
a second folding tab section extending from a left-side edge of the partitioning section, and configured for folding about a vertically extending fold line located at said left-side edge.
17. The partition container of claim 15 wherein:
a said folding tab section of said adjacent interior partition extends through said gap, and substantially across two individual compartments of said partitioned container.
18. The partition container of claim 15, wherein:
said slots of each interior partition define spacing between each of a plurality of panel tabs; and
wherein each panel tab comprises non-right-angle corners along an open edge.
19. A partitioned container comprising:
one or more exterior panels defining an interior compartment;
a first number of interior partitions, each comprising:
a partitioning section comprising a number of slots extending from one of a top edge or a bottom edge to an intermediate height;
a folding tab section extending from one of a first side edge of the partitioning section such that a second side edge comprises a free edge, wherein said folding tab section is configured for folding about a vertically extending fold line located at an intersection of the partitioning section and said folding tab section;
wherein each of said folding tab sections are attached to one of said one or more exterior panels;
wherein each of said partitioning sections extend alongside one another and substantially cross said interior compartment in a first direction;
a second number of interior partitions, each comprising:
a partitioning section comprising a number of slots extending from one of a top edge or a bottom edge to an intermediate height thereof;
a first folding tab section extending from a right-side edge of the partitioning section, and configured for folding about a vertically extending fold line located at said right-side edge;

a second folding tab section extending from a left-side edge of the partitioning section, and configured for folding about a vertically extending fold line located at said left-side edge;

wherein each of said partitioning sections extend alongside one another and substantially cross said interior compartment in a second direction intersecting said first direction;

wherein each of said first folding tab sections and each of said second folding tab sections are attached to one of said one or more exterior panels;

wherein said slots of each interior partition define spacing between each of a plurality of panel tabs, wherein each panel tab comprises non-right-angle corners along an open edge;

wherein each of said partitioning sections of each of said first number of interior partitions are mated with each of said partitioning sections of each of said second number of interior partitions by way of said slots in said partitioning sections of said first and second number of interior partitions to define a series of individual compartments within the interior compartment;

wherein a gap is included between said free edge of said partitioning section of each of said first number of interior partitions and an interior surface of an adjacent portion of said one or more exterior panels;

wherein each folding tab section of said first number of interior partitions extends through one of said gaps substantially across two individual compartments of said partitioned container; and wherein said partitioned container is adapted to be folded about fold lines such that adjacent, parallel interior partitions are substantially in contact with one another.

* * * * *